US007523578B2

(12) United States Patent
Ghisoni

(10) Patent No.: US 7,523,578 B2
(45) Date of Patent: Apr. 28, 2009

(54) REVOLVER

(75) Inventor: Emilio Ghisoni, Pavia (IT)

(73) Assignee: Far League S.R.L., Milan (IT)

( * ) Notice: Subject to any disclaimer, the term of this patent is extended or adjusted under 35 U.S.C. 154(b) by 505 days.

(21) Appl. No.: 10/962,988

(22) Filed: Oct. 8, 2004

(65) Prior Publication Data

US 2005/0126062 A1 Jun. 16, 2005

(30) Foreign Application Priority Data

Apr. 11, 2003 (IT) ..... MI2003A0764

(51) Int. Cl.
*F41C 3/14* (2006.01)

(52) U.S. Cl. ..... 42/59; 42/62; 42/65

(58) Field of Classification Search ..... 42/59, 42/62, 65

See application file for complete search history.

(56) References Cited

U.S. PATENT DOCUMENTS

| | | | | |
|---|---|---|---|---|
| 2,835,171 | A * | 5/1958 | Lyon | 89/13.05 |
| 4,041,633 | A * | 8/1977 | Scrufari | 42/65 |
| 4,285,152 | A * | 8/1981 | Dean | 42/59 |
| 6,016,736 | A * | 1/2000 | Ghisoni | 89/157 |
| 6,234,058 | B1 * | 5/2001 | Morgado | 89/33.03 |
| 7,201,094 | B2 * | 4/2007 | Jebsen et al. | 89/189 |

* cited by examiner

*Primary Examiner*—J. Woodrow Eldred
(74) *Attorney, Agent, or Firm*—Andrew Wilford

(57) ABSTRACT

A revolver that has firing means arranged so as to substantially raise the resting point of the middle finger of the hand on the handle.

24 Claims, 9 Drawing Sheets

REVOLVER

FIELD OF THE INVENTION

The present invention to a pistol with drum rotation also commonly known as a "revolver".

BACKGROUND OF THE INVENTION

A single action revolver is known, in which the hammer, normally actuated by the thumb of the hand, also produces the rotation of the drum. In such a revolver, firing is caused by a subsequent and distinct movement of the index finger of the hand that presses the trigger. Such a type of revolver is recommended for target shooting.

A double-action revolver is also known in which firing is produced by simply pulling the trigger. Such a type of revolver, on the other hand, is much more highly recommended for firing many shots in quick succession even without much precision.

In known revolvers, the recoil force that is generated at the moment of firing produces a moment of rotation on the hand that is substantially proportional to the distance between the axis of the barrel and the median axis of the forearm. The greater such a distance, the greater the tendency of the pistol to recoil or rotate. Therefore at each shot the firearm tends to push down into the hand and tends to rotate between thumb and index finger forcing the firer to take aim once again.

Moreover, in known revolvers, in normal holding of the firearm, the barrel points downwards and can only be taken into horizontal alignment with a considered twist of the wrist upwards. This substantially complicates instinctive shooting.

In order to reduce the recoil of the firearm it has been proposed t bring the barrel into alignment with the lower firing chamber of the drum. However, this has also brought about the lowering both of the hammer and of the relative actuation mechanism and consequently of the point at which the hand rests, which has partially made the advantage achieved futile.

A further drawback of known revolvers is linked to the weight of the firearm.

To reduce the weight of the firearm it has notoriously been attempted to make the fore-end from a light and easily workable material like an aluminum-based alloy, but one is yet to find a light and easily workable material that can at the same time offer high mechanical strength.

With current materials, after a certain number of shots, there is a deformation of the upper transom of the window of the drum that makes the firearm unusable.

The use of titanium and its alloys has been proposed, which is suitable in terms of mechanical strength and lightness but not highly recommended due to cost and workability.

Another drawback of known revolvers is linked to their bulk, for which reason they are generally longer than semi-automatic pistols with the same barrel length.

To compact the firearm a division of the trigger has been proposed by operatively connecting an inner trigger or distributor to the outer trigger, suitable for locking, unlocking and rotating the drum, arming and unhooking the hammer. In this case the outer trigger is suitable just for transmitting the movement of the finger to the distributor through a connecting rod between the two parts.

OBJECT OF THE INVENTION

The object of the present invention is, therefore, to provide a revolver that allows the aforementioned technical drawbacks of the prior art to be eliminated.

A further object of the invention is to provide a revolver capable of reducing to the minimum the tendency of the firearm to recoil and push down into the hand of the firer at each shot.

Another object of the invention is to provide a firearm that, once instinctively held, arranges the barrel in alignment with the axis of the forearm so as to allow precise instinctive firing.

A further object of the present invention is to provide a revolver that is-light and at the same time that is able to offer high mechanical strength so as to always ensure optimal performance through time, even using powerful cartridges.

Last but not least, it is an object of the present invention to provide an extremely compact revolver.

SUMMARY OF THE INVENTION

These objects of the present invention are accomplished by making a revolver has firing means arranged so as to substantially raise the resting point of the middle finger of the hand on the handle.

The firing means can have a first hinging point to the fore-end of the firearm, which rotatably carries a trigger of the firearm, an anchor for locking and unlocking the drum, and a spring suitable for keeping the anchor in position locking the drum.

The firing means can have a second hinging point to the fore-end of the firearm, which rotatably carries an inner distributor of the movement of the trigger suitable for arming the hammer, and a counter-hammer suitable for locking the armed hammer. The distributor can have a first portion suitable for commanding the arming of the hammer, a second portion that can respectively engage with and disengage from said anchor to respectively lock and unlock the drum, and a third portion in which a hinging point is formed that rotatably carries a foot kept engaged against the toothing of the drum for the actuation thereof. The distributor fixedly carries a dragging member suitable for pulling the counter-hammer into rotation at the end part of the stroke of said trigger to unlock said hammer and cause firing.

The hinging point of the hammer can be arranged to be substantially vertically aligned with the point in which the hammer strikes the cartridge capsule. This hinging point of the hammer can be arranged between the hinging point of the rotation foot of the drum and the hinging point of the distributor.

The firing means can have a hinging point to the fore-end of the firearm which rotatably carries an arming element of the hammer in the operation of the single action firearm, or pseudo-hammer, a torsion spring and an element that commands the disengagement of the drum. A connecting rod directly or indirectly associated with said hammer to actuate and is articulated from the pseudo-hammer.

The torsion spring can have a first stem associated with the connecting rod for pulling the pseudo-hammer back into the rest position after it has carried out the arming. of the hammer.

The pseudo-hammer can be arranged in a rear high part of the handle above the hilt and can project outside of the fore-end to be able to be pulled by the thumb of the hand.

The revolver can have a system for locking the withdrawal of the drum when it is removed from the relative window for loading new cartridges or for expelling fired cartridge cases having engagement members between the drum and the extraction arm of the drum from the relative window.

This anti-withdrawal system can comprise a nose projecting from the base of the drum facing the barrel, the nose carrying a recess with circular section that rotatably couples with a matching profile of a portion of the head of a cylinder removably housed in the extraction arm of the drum.

Reinforcement means can be provided for the side of the window of the drum that faces the base of the cartridge cases, the reinforcement means comprising a removable plate made from material with high mechanical strength.

The hinging point of the distributor also rotatably carries a repositioning member or intermediary, suitable for taking the firing means back into the initial configuration taken up by it before the trigger was pulled, the intermediary indirectly transmitting the movement to the distributor acting against an appendix of the rotation foot of the drum so as to constantly ensure a contact pressure of the rotation foot of the drum against the toothing of the drum.

To make the hammer safe, the peripheral edge of the third portion of the distributor is able to intercept a pin mounted in relief on the hammer so that when the distributor returns, before the end stop of the trigger, the intercepted pin causing the hammer to pull back and consequently the firing pin to move away from the cartridge capsule.

The firing means can have a hinging point to the fore-end of the firearm, which supports a spring that continuously acts on an abutment of said intermediary to return the firing means back into the rest configuration.

The connecting rod has a detectable interference member at one end, during the pulling back of said pseudo-hammer starting from a rest position, against the application point of the rotation spring on the hammer to carry out the arming of the hammer. The torsion spring can have a second stem associated with a locker equipped with a cylindrical extension suitable for holding the drum in the closed position. The locker can hold an appendix of said disengagement element of the drum so that the manual rotation of said disengagement element of the drum allows the drum to be freed.

In another feature, a hinging point to the fore-end of the firearm carries a spring having a first stem suitable for actuating the firing means through a first lever so as to take said firing means back into the rest configuration taken up before the trigger was pulled, and a second stem suitable for actuating the hammer through a second lever having a common rotation pin with said first lever. The first lever transmits the movement to an appendix of the foot so as to constantly ensure a contact pressure of the foot against the toothing of the drum.

The control element for the disengagement of the drum can be associated with a cylindrical pin suitable for holding the drum in the closed position. The cylindrical pin can have a circumferential groove where a ball actuated by a spring to hold the drum snaps in.

The revolver can also have a further sealing system that opposes the slipping out of the drum, consisting of a ball that, pushed by a spring, is arranged in an imprint of the drum extraction arm.

BRIEF DESCRIPTION OF THE DRAWING

Further characteristics and advantages of the invention shall become clearer from the description of a preferred but not exclusive embodiment of the revolver according to the invention, with reference to the drawing in which.

SPECIFIC DESCRIPTION

Figure 1:
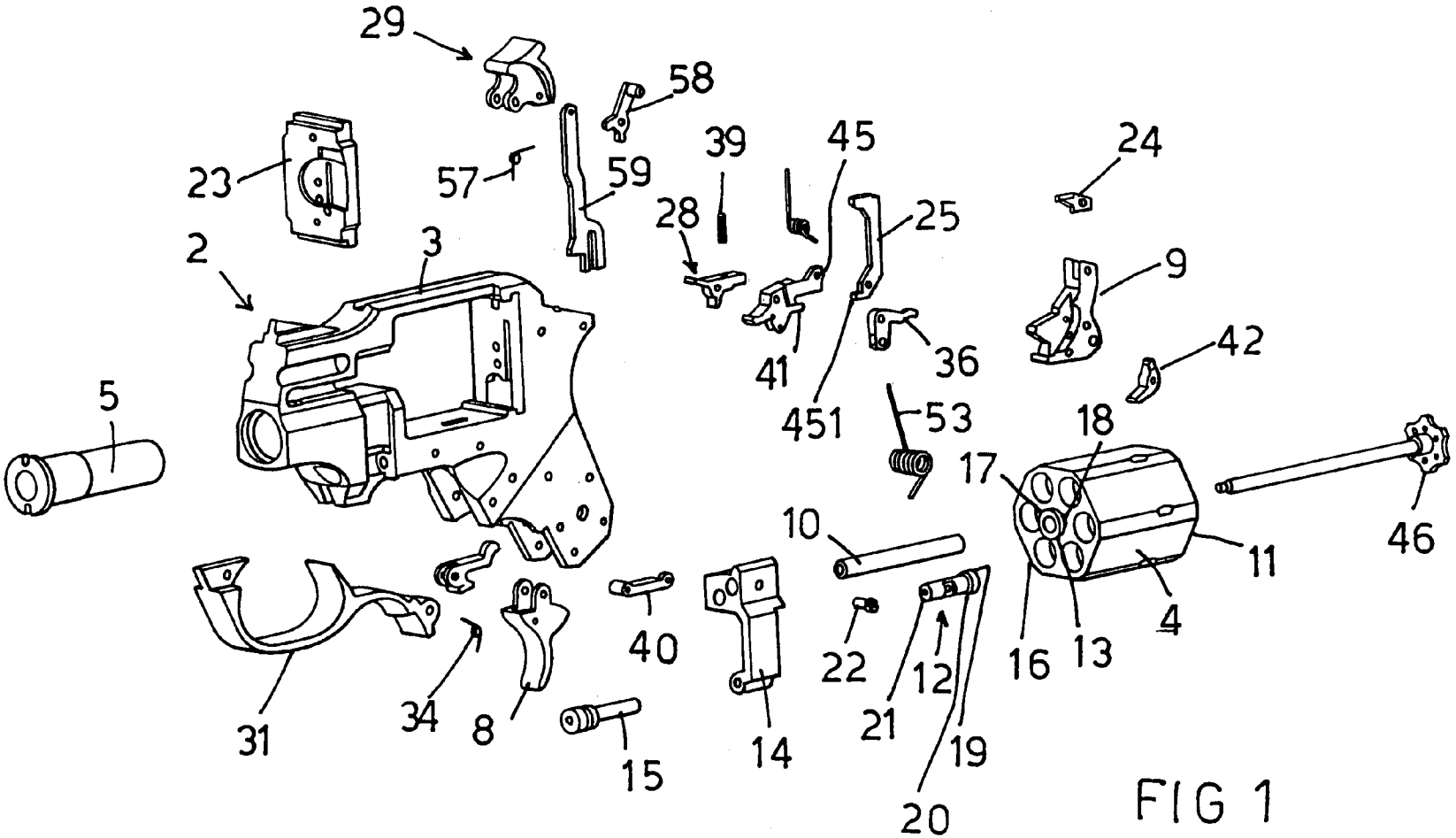
FIG. 1 is an exploded view of the revolver according to a first preferred embodiment of the present invention.
Figure 2:
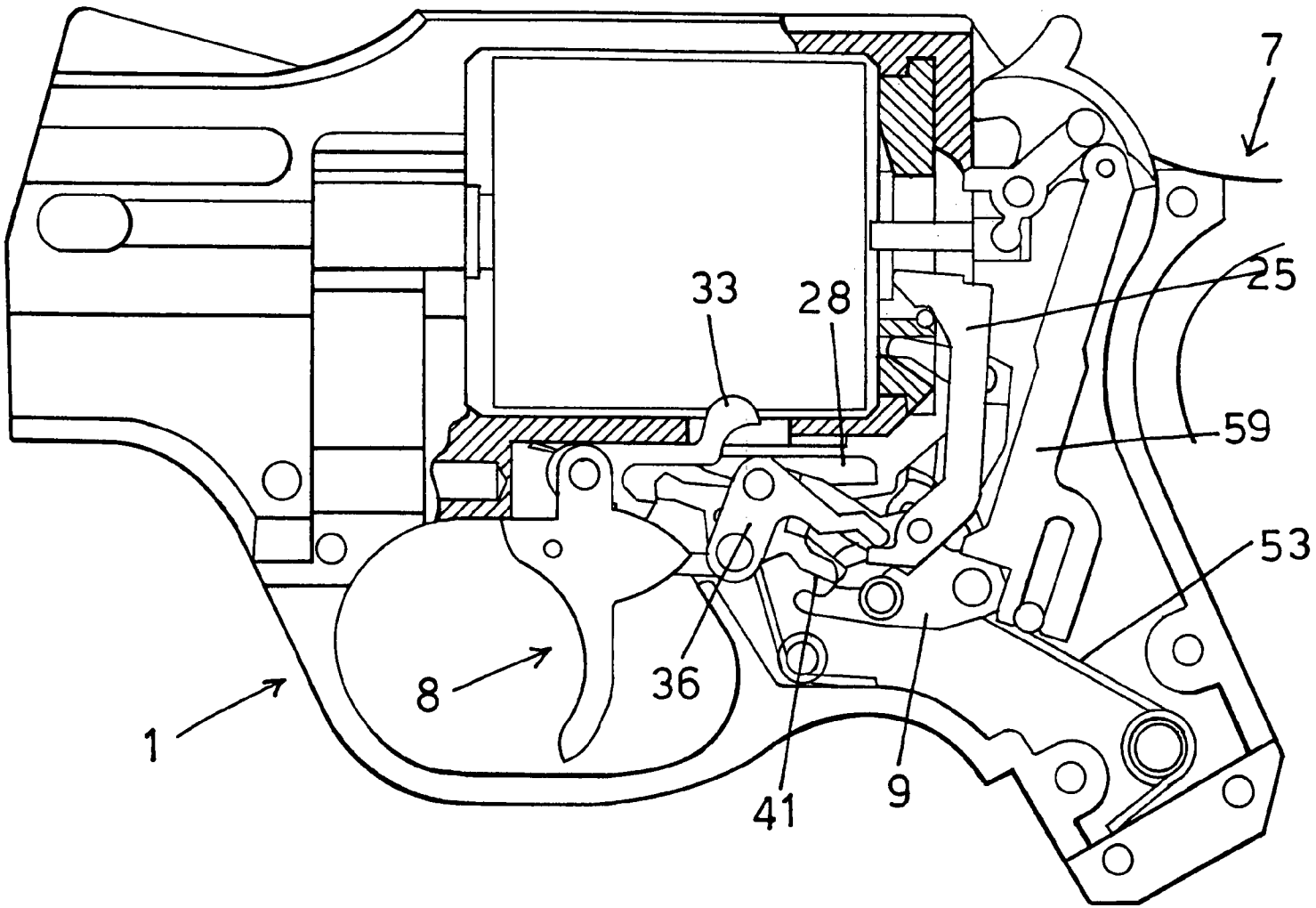
FIGS. 2-6 show side views of the revolver of FIG. 1 (partly in section) with various components of the firing means, and with the trigger in rest position.
Figure 3:
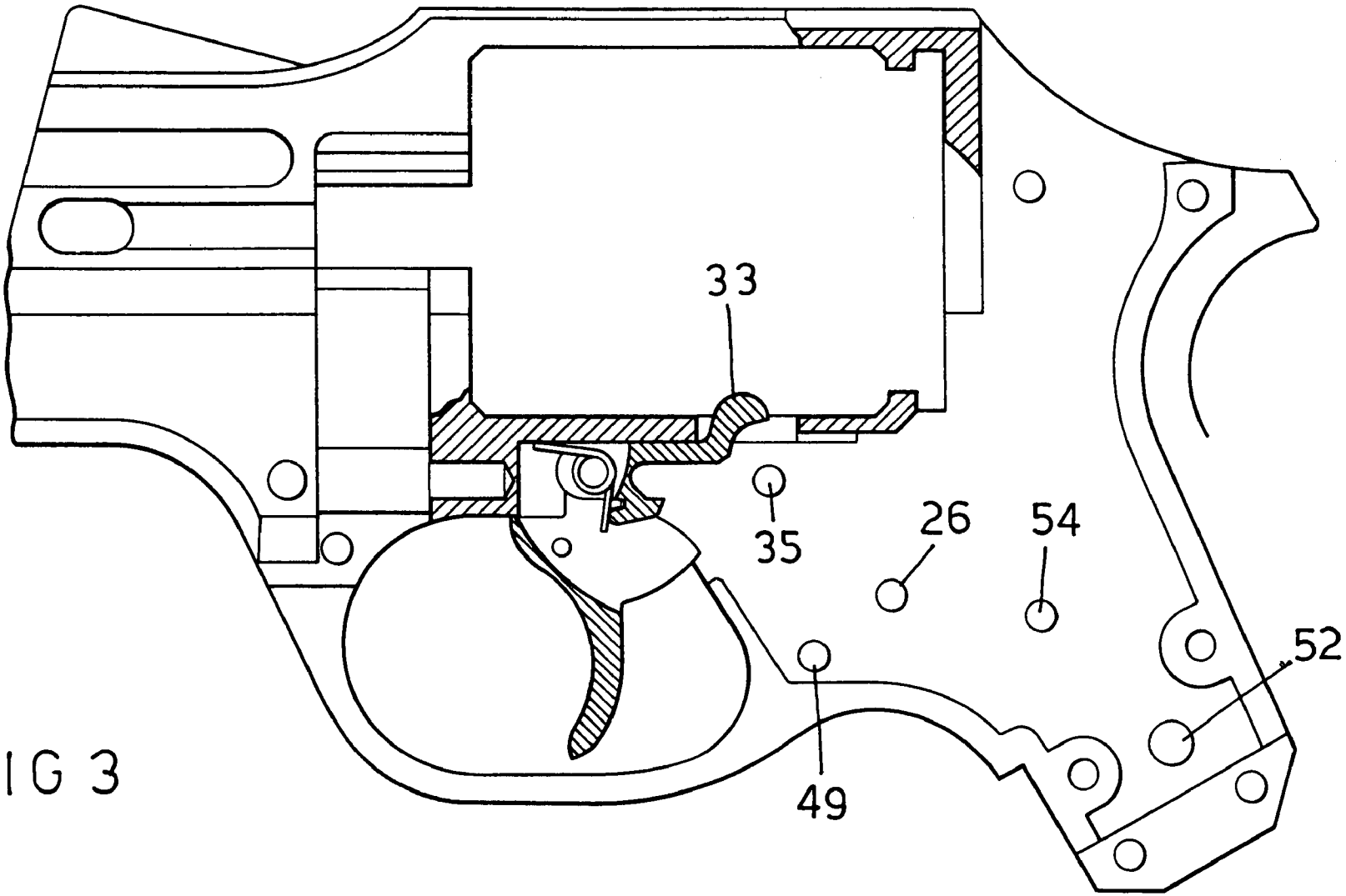
Figure 4:
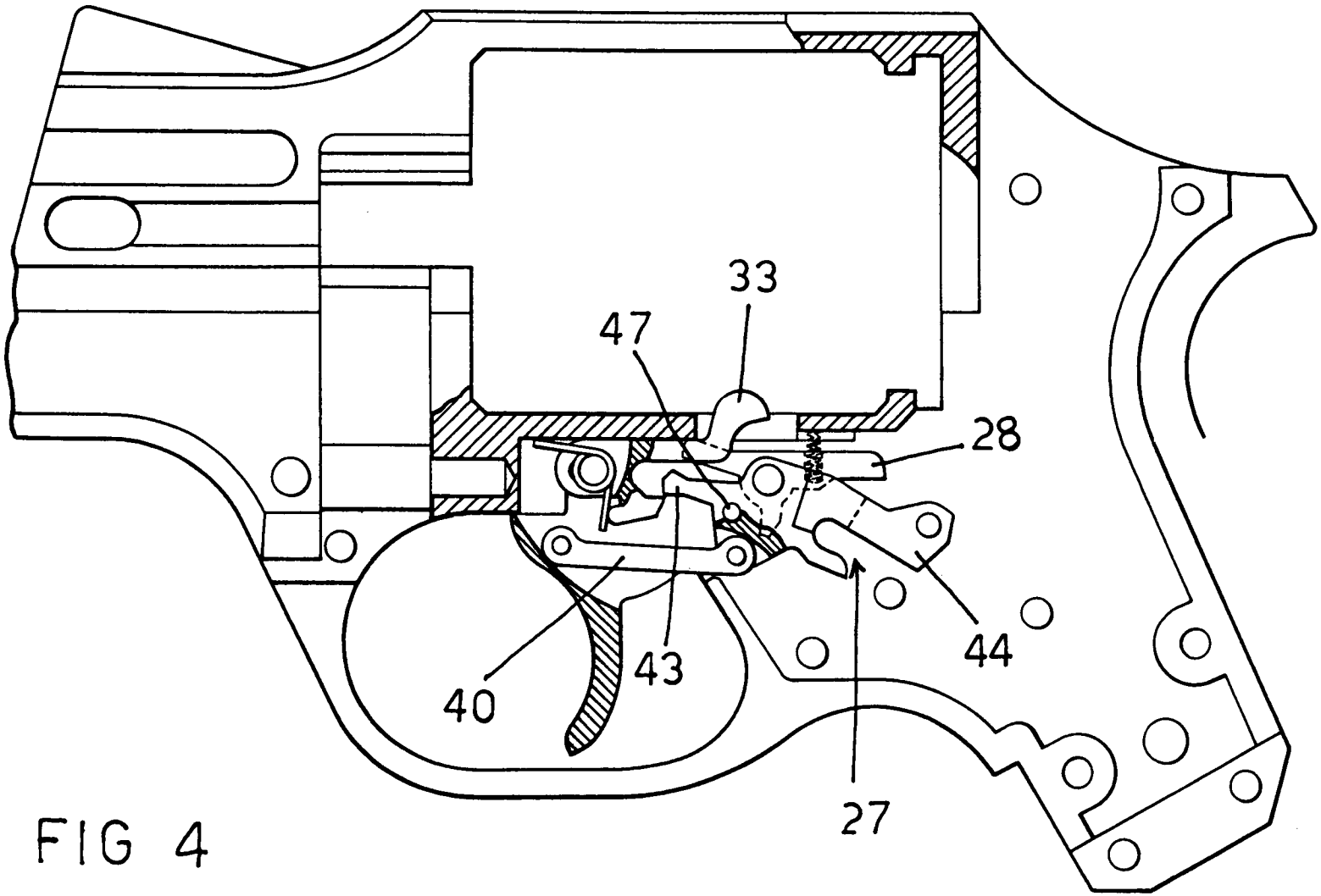
Figure 5:
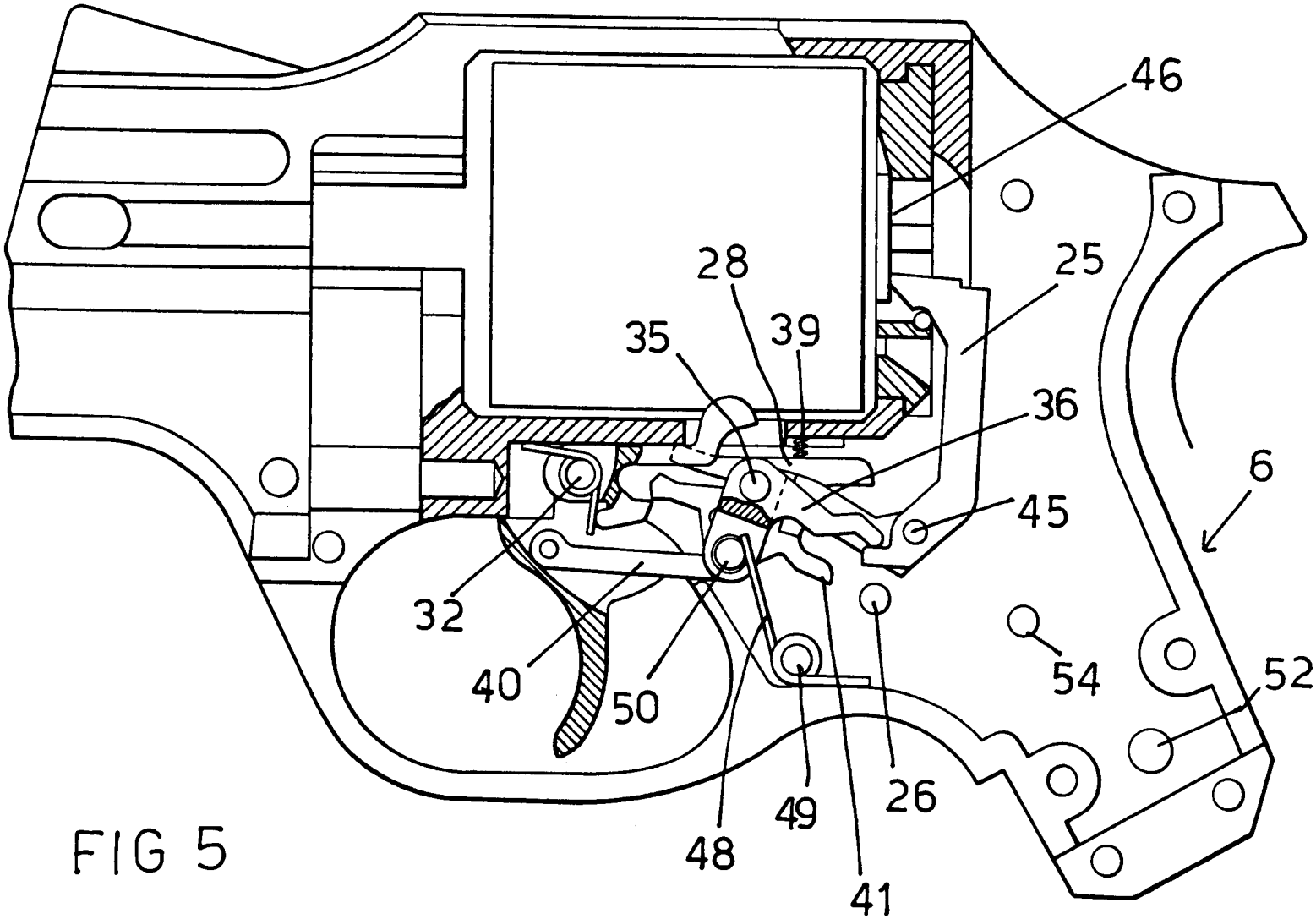
Figure 6:
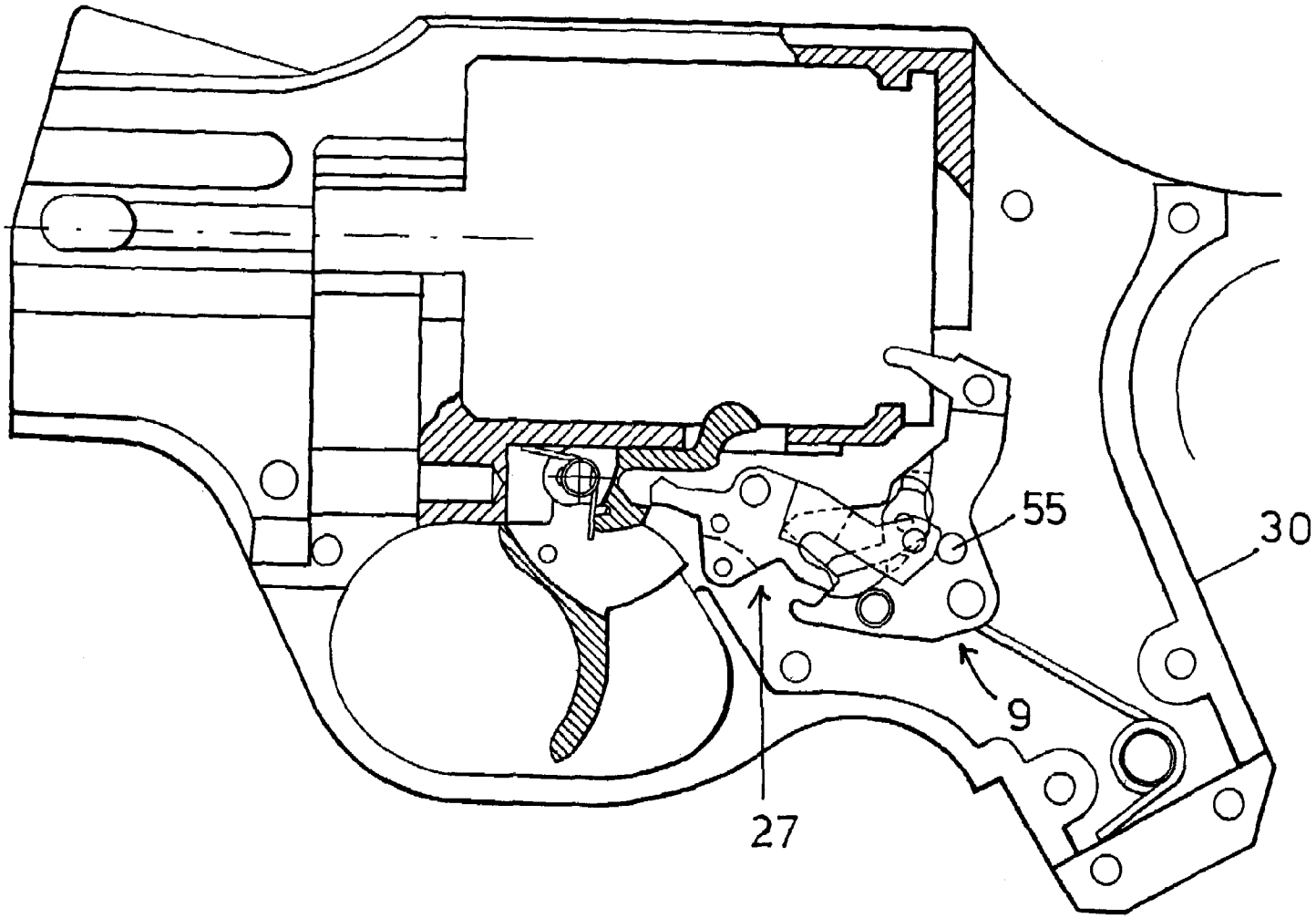
Figure 7:
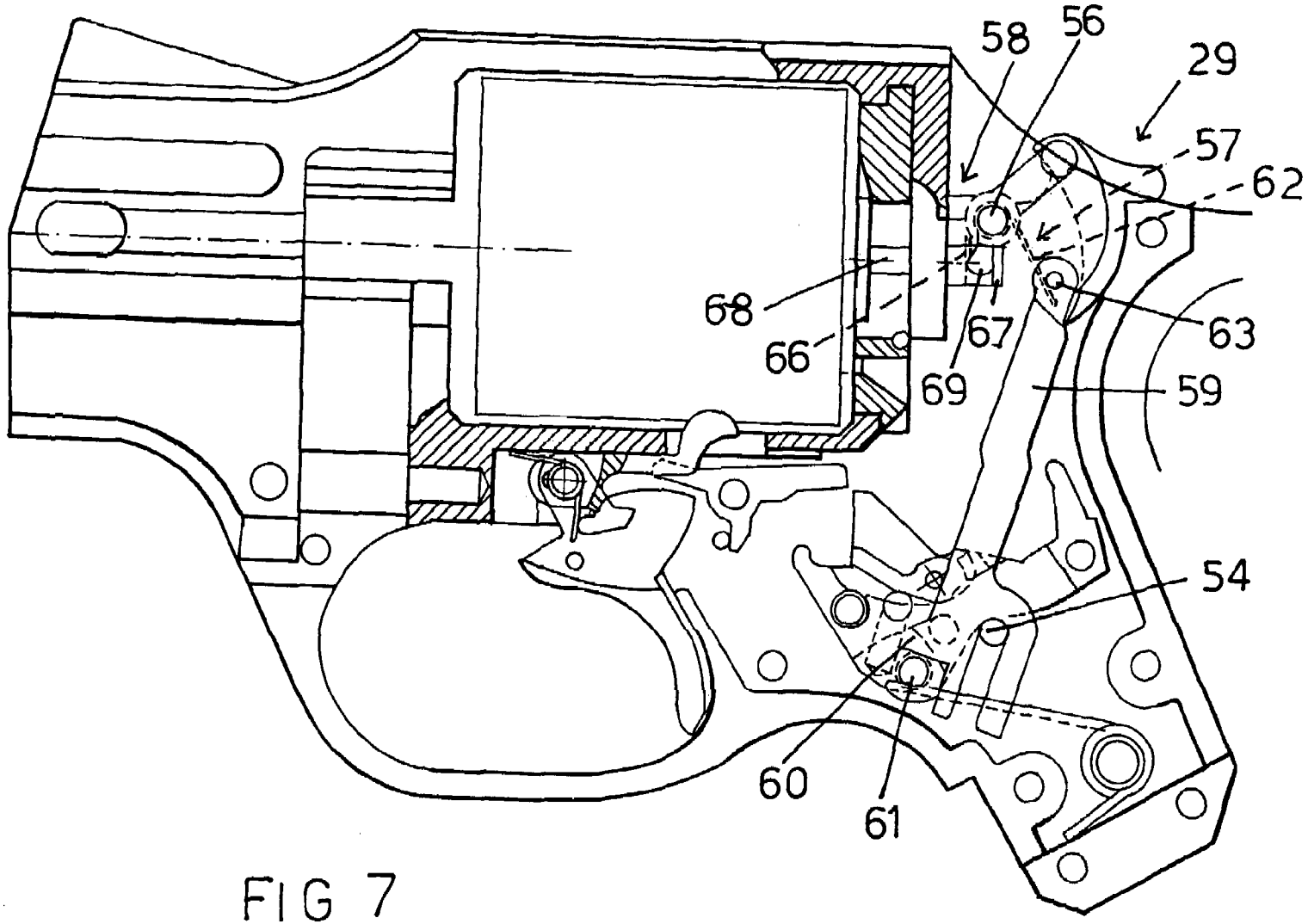
FIG. 7 is side view of the revolver of FIG. 1 with the trigger in firing position.

Equivalent parts in the figures have been indicated with the same reference numerals.

The drawing shows a revolver 1.

The revolver 1 comprises a frame having a fore-end 2 in which a window 3 is formed for housing the drum 4,.a barrel 5 that extends from the fore-end 2, a handle 6 with hilt 7, and an outer trigger 8 operatively connected to a hammer 9 inside the fore-end 2 and able to be made to strike on the base of the cartridge case to cause firing.

The revolver 1, as illustrated, has. the lower firing chamber of the drum 4 aligned with the axis of the barrel 5.

Advantageously, the drum 4 is hexagonal-shaped that reduces the thickness of the firearm without penalizing its is robustness, whereas the distance between the front face 11 of the drum 4 and the handle 6 is reduced to a few millimeters to reduce the length of the firearm. Since the bulk of the handle that has been brought closer would prevent the loading and removal of the cartridges it has had to be ensured that when coming out the drum moves further away from the fore-end making a new system necessary to avoid it withdrawing when it is removed from the relative window 3 for loading new cartridges or for expelling fired cartridge cases. Such an anti-withdrawal system of the drum has engagement members 12 and 13 between the drum 4 and the arm 14 for removing the drum from the relative window 3, said removal arm 14 rotatably carrying, as known, at one of its ends, the drum 4 and at its other end being hinged with a pin 15 to the fore-end 2.

In particular, from the rear base 16 of the drum 4, in other words from the base of the drum 4 facing the barrel 5, projects a nose 17 that carries a recess 18 with a circular profile that rotatably couples with a matching profile of a portion 19 of the head 20 of a cylinder 21 removably housed in the drum extractor 14. For example, the cylinder 21 is held in the extractor 14 through a screw 22 screwed into the cylinder 21 itself. Of course, the removal of the drum 4 for cleaning or inspection is made possible by simply unscrewing the screw 22 is from the cylinder 21.

Advantageously, moreover, it is possible to introduce removable reinforcing means of the side of the window 3 of the drum 4 that faces the base of the cartridge cases to allow the fore-end 5 of the firearm to still be made from extremely light material, for example aluminum alloy.

Such reinforcement means comprise a plate 23 made from a material with high mechanical strength, for example steel, which can be inserted in dove-tail fashion at the side of the window 3 of the drum 4 the faces the base of the cartridge cases and held here by suitable fastening pins (not shown).

Such a reinforcement plate 23 has the double advantage of opposing the pressure exerted by the base of the cartridge case at the time of firing with a non-deformable obstacle, thus distributing the pressure over a very large surface of the fore-end 2, and of allowing operations to be carried out on it in a very simple way, such as the discharge for the return of the drum 4, the hole of the firing pin 24 and the cut for the rotation foot 25 of the drum 4 which would otherwise be carried out in a much more complex manner on the fore-end 2. Preferably, the operation of the revolver is of the mixed action type, in other words it can operate either with single or double action.

The correct operation of the firearm both in double action and in single action is ensured by guaranteeing a certain striking speed of the hammer 9 upon striking, depending upon the distance between the hinging 26 of the hammer 9 and the striking point or upon the size of the angular stroke of the hammer 9 from the armed position to the striking position.

To do this an inner distributor 27 of the movement of the outer trigger 8, suitable for arming the hammer 9, and a distinct element, hereafter known as counter-hammer 28, suitable for blocking the armed hammer, are provided, rotatably supported at a common hinging point to the fore-end 2 of the firearm.

By removing the function of blocking the armed hammer from the distributor 27 and if necessary providing a blocking element 28 distinct from the distributor 27 but hinged at the same point, it is possible to reduce the difference in angular stroke of the hammer 9 between the operation of the firearm with single action and double action to just 3 degrees.

In double-action operation of the revolver the hammer 9 is armed and released for shooting with a single movement of the outer trigger 8 that actuates the distributor 27 both to arm and to release the hammer 9, whereas in single-action operation of the revolver the hammer 9 is armed with a first movement through an outer hammer, hereafter also known as pseudo-hammer 29, whereas the release of the inner hammer 9 for firing takes place with a second movement of the outer trigger 8.

The firing means are contained in the space between the back 30 of the handle, the front face 11 of the drum 4 and the trigger guard 31, with the exception of the pseudo-hammer 29, as we shall see, which partially projects outside the upper part of the hilt 7 of the handle 6.

In particular, such firing means have a plurality of hinging points to the for-end 2 of the firearm as described hereafter.

A first hinging point 32 to the fore-end 2 of the firearm rotatably carries the trigger 8 and the anchor 33 for locking and unlocking the drum 4, as well as the spring 34 that continuously presses the anchor 33 on the drum 4 in the position locking the drum 4.

At the first hinging point 32 there is a small clearance in the direction parallel to the axis of the drum suitable for allowing the locking and unlocking, respectively, between the anchor 33 and the distributor 27.

A second hinging point 35 to the fore-end 2 of the firearm rotatably carries the distributor 27 and the counter-hammer 28.

The counter-hammer 28 is movable from the locked position to the unlocked position against the action of a spring 39 that continuously pulls it back to the locked position. The transmission of movement from the trigger 8 to the distributor 27 is ensured by a connecting rod 40.

The distributor 27 has a first portion 41 suitable for controlling the arming of the hammer 9. Such a first portion 41 of the distributor 27 acts only indirectly on the hammer 9, actually being taken into direct contact with a mobile bill 42 in turn hinged on the hammer 9.

The distributor 27 also has a section portion 43 that can engage with and, respectively, disengage from the anchor 33 for respectively locking and unlocking the drum 4. The distributor 27 also has a third portion 44 in which a hinging point 45 is formed that rotatably carries the foot 25 kept engaged against the toothing 46 of the drum 4 for the actuation thereof.

Finally, the distributor 27 fixedly carries a dragging member 47 suitable for pulling the counter-hammer 28 into rotation at the end part of the stroke of the trigger 8 to unlock the hammer 9 and cause firing. we shall now refer, in particular, to the embodiment of FIGS. FIGS. 1-7.

The second hinging point 35 to the fore-end of the firearm also rotatably carries a repositioning member, here forth known as intermediary 36, suitable for taking the firing means back into the rest configuration taken up before the trigger was pulled.

A third hinging point 49 to the fore-end 2 of the firearm supports the spring 48 that continuously acts on an abutment 50 of the intermediary 36 to take the firing means back into the rest configuration taken up before the trigger 8 was pulled.

The intermediary 36 does not transmit the movement directly to the distributor 27 but to an appendix of the foot 25 hinged to the distributor 27 so as to constantly ensure a contact pressure cf the foot 25 against the toothing 46 of the drum 4.

A fourth hinging point 26 to the fore-end 2 of the firearm, as stated, rotatably carries the hammer 9.

A fifth hinging point 52 to the fore-end 2 of the firearm supports a spring 53 acting at a point of application on the hammer 9 to actuate its rotation.

A sixth hinging point 54 to the fore-end 2 of the firearm defines a pin for intercepting the spring 53 that actuates the rotation of the hammer 9.

There is a further interaction between the distributor 27 and the hammer 9 to make it safe. The peripheral edge of the appendix 44 of the distributor. 27 that carries the foot 25, indeed, is able to intercept a pin 55 mounted in relief on the hammer 9.

When the distributor 27 returns, before the end stop of the trigger 8, the pin 55 is intercepted causing the hammer 9 to pull back and consequently the firing pin 24 to move away from the cartridge capsule. In this slight pulling back of the hammer 9 the rotation spring 23 of the hammer 9 is not compressed since it is intercepted by the relative intercept pin 54. This means that the last part of the stroke of the hammer 9 is carried out by inertia.

A seventh hinging point 56 to the fore-end 2 of the firearm supports the pseudo-hammer 29, a double effect torsion spring 57 and an element 58 that commands the disengagement of the drum 4.

The pseudo-hammer 29 is arranged in the rear high part of the handle 6 above the hilt 7 and projects outside of the fore-end 2 to be able to be actuated by the thumb of the hand.

An end of a connecting rod 59 is hinged on the pseudo-hammer 29, with its opposite shaped end slidably bound to the pin 54 itself for intercepting the spring 53 of the hammer 9.

The connecting rod 59 has a detectable interference member 60 at one end, during the pulling back of the pseudo-hammer 29 starting from its rest position, with the same point 61 of application of the rotation spring 53 on the hammer 9 to carry out the arming of the hammer 9.

The connecting rod 59 simply rests on the hammer 9 so that the torsion spring 57, which has a first stem 62 associated at 63 with the connecting rod 59, can take the pseudo-hammer 29 back into the rest position after the arming of the hammer 9.

The same torsion spring 57 has a second stem 66 associated with a locker 67 equipped with a cylindrical extension 68 suitable for holding the drum 4 in the closed position.

The locker 67 holds an appendix 69 of the disengagement element 58 of the drum 4 that is simply rotated manually to free the drum 4.

Figure 8:
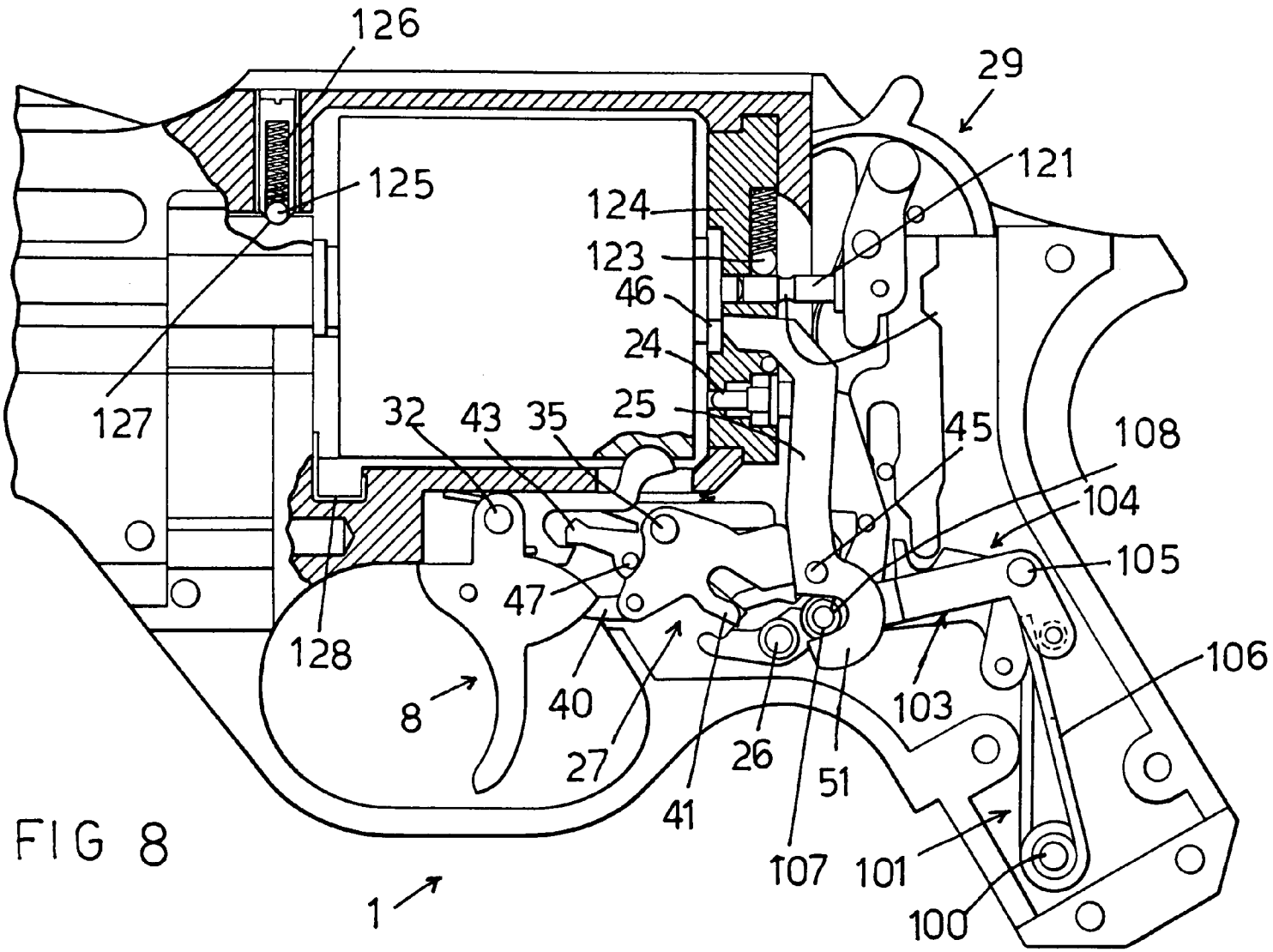
FIG. 8 is side view of a revolver according to a second preferred embodiment of the invention with the components of the firing means, and with the trigger in rest position.
Figure 9:
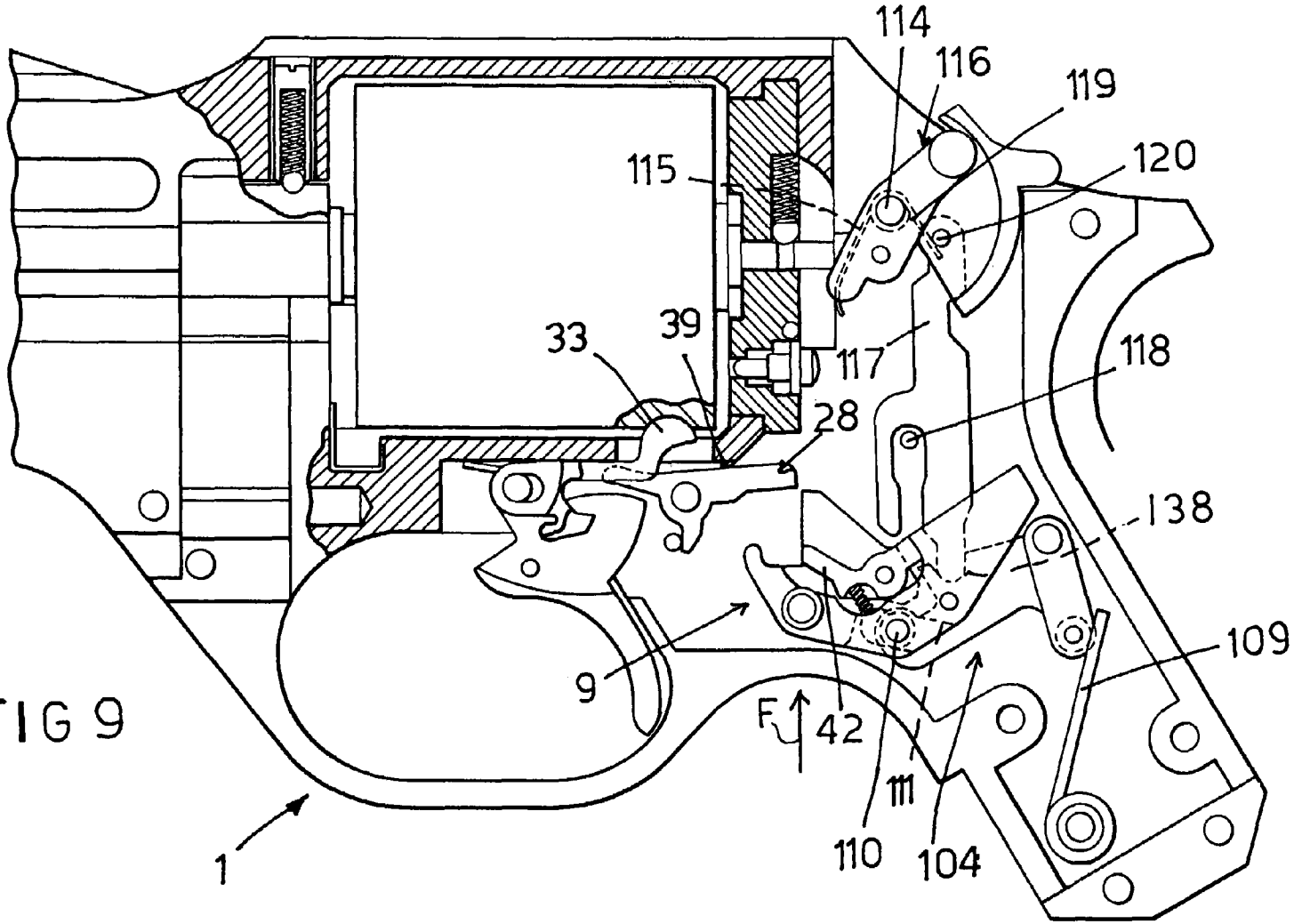
FIG. 9 is side view of a revolver of FIG. 8 with some components of the firing means, and with the trigger in firing position.

In FIGS. 8 and 9, a third hinging point 100 to the fore-end of the firearm carries a spring 101 suitable on one side for indirectly actuating the firing means, through a first lever, so as to take them back into the rest configuration taken up before the trigger was pulled, and on the other side. for indirectly actuating the hammer 9, through a second lever 104.

The fore-end of the firearm has a fourth hinging point is 105 that rotatably carries both the first lever 103 and the second lever 104.

In particular, the first lever 103 has an arm commanded by a first stem 106 of the spring 101 and a control arm that transmits the movement to an appendix 51 of the foot 25 so as to constantly ensure a contact pressure of the foot 25 against the toothing 46 of the drum 4.

The transmission of the movement to the appendix 51 is ensured by a dragging member 107 engaged in a fixing seat 108 formed from the appendix 51.

The second lever 104, on the other hand, has an arm commanded by the second stem 109 of the spring 101 and a control arm that transmits the movement to the hammer 9.

The transmission of the movement to the hammer 9 is ensured by a dragging member 110 engaged in an open slot 111 of the hammer 9.

A fifth hinging point 26 to the fore-end 2 of the firearm, as stated, rotatably carries the hammer 9.

With respect to the embodiment of FIGS. 1-7, in the embodiment of FIGS. 8 and 9 the thrusting point of the hammer 9 is raised. This means a bi rise of the resting point of the middle finger, indicated by arrow "F", and this is very useful for a better grip of the firearm.

Moreover, by making both of the stems of the spring 101 work, it is possible to improve striking since the effort needed to cause it is reduced.

The fore-end 2 of the firearm has a member 112 for intercepting the second stem 109 of the spring 101.

A sixth hinging point 114 to the fore-end 2 of the firearm supports the pseudo-hammer 29, a torsion spring 113 and an element 116 that commands the disengagement of the drum 4.

Also in this case the pseudo-hammer 29 is arranged in the rear high part of the handle 6 above the hilt 7 and projects outside of the fore-end 2 to be able to be actuated by the thumb of the hand.

On the pseudo-hammer 29 there is a rotation pin 120 to which an end of a connecting rod 117 between the pseudo-hammer 29 and the second lever 104 is hinged.

The connecting rod 117 is slidably associated with a guide pin 118 integral with the fore-end 2 and has the other end engaged in a recess 138 of the second lever 104.

The pseudo-hammer 29 actuates the connecting rod 117, which through the second lever 104 transmits the movement to the hammer 9 arming it.

The connecting rod 117 engages by simply resting in the recess 138 so that the torsion spring 115, which has a stem 119 acting against the rotation pin 120, can take the pseudo-hammer 29 back into the rest position during the arming of the hammer 9.

The control element 116 acts on a cylindrical pin 121 suitable for holding the drum 4 in the closed position.

The cylindrical pin 121 has a circumferential groove 122 where a ball 123 actuated by a spring 124 snaps in.

The engagement of the drum 4 therefore occurs when, by means of the manual actuation of the control element 116, the ball 123 is introduced into the groove 122, and, vice-versa, the disengagement of the drum 4 occurs when, again by means of the manual actuation of the control element 116, the ball 123 is removed from the groove 122.

With respect to the embodiment o 1-7, in the embodiment of FIGS. 8 and 9 there is a further sealing system that opposes the slipping out of the drum 4, consisting of a ball 125 that, pushed by a spring 126, is arranged in an imprint 127 of the removal arm 14 of the drum.

Moreover, in the embodiment of FIGS. 8 and 9 there is a recess 128 in the drum housing window for conveying the firing gases suitable for conveying them laterally to avoid dirtying the hand.

In the present invention, the containment of the overall length of the firearm has been solved in an extremely through the second lever 104 transmits the movement to the hammer 9 arming it.

The connecting rod 117 engages by simply resting in the recess 138 so that the torsion spring 115, which has a stem 119 acting against the rotation pin 120, can take the pseudo-hammer 29 back into the rest position during the arming of the hammer 9. The control element 116 acts on a cylindrical pin 121 suitable for holding the drum 4 in the closed position. The cylindrical pin 121 has a circumferential groove 122 where a ball 123 actuated by a spring 124 snaps in. The engagement of the drum 4 therefore occurs when, by means of the manual actuation of the control element 116, the ball 123 is introduced into the groove 122, and, vice-versa, the disengagement of the drum 4 occurs when, again by means of the manual actuation of the control element 116, the ball 123 is removed from the groove 122.

With respect to the embodiment of FIGS. 1-7, in the embodiment of FIGS. 8 and 9 there is a further sealing system that opposes the slipping out of the drum 4, consisting of a ball 125 that, pushed by a spring 126, is arranged in an imprint 127 of the removal arm 14 of the drum.

Moreover, in the embodiment of FIGS. 8 and 9 there is a recess 128 in the drum housing window for conveying the firing gases suitable for conveying them laterally to avoid dirtying the hand.

In the present invention, the containment of the overall length of the firearm has been solved in an extremely simple manner through purposeful arrangement of the hinging points of the firing means of the firearm to the fore-end of the firearm, and in particular arranging the hinging point of the hammer 9 substantially vertically aligned with the point in which the hammer 9 strikes the cartridge capsule.

To obtain the substantial zeroing of the misalignment between the hinging point of the hammer 9 and the point in which the hammer 9 strikes the cartridge capsule, the hinging point of the hammer 9 is advantageously arranged between the hinging point of the rotation foot 25 of the drum 4 and the hinging point of the distributor 27.

The revolver thus conceived can undergo numerous modifications and variants, all of which are covered by the inventive concept; moreover, all of the details can be replaced with technically equivalent elements.

The invention claimed is:

1. A revolver comprising:

a revolver frame having a front muzzle end and a rear frame end;

a grip extending downward from the rear frame end of the frame and adapted to be held in a hand of a shooter;

a barrel projecting forwardly from the front muzzle end and having a bore centered on a barrel axis extending rearward through the grip;

a trigger projecting downward from the frame forward of the grip and engageable by a finger of the hand of the shooter holding the grip;

a cartridge cylinder received in said frame rearward of the barrel, having a plurality of chambers each adapted to hold a respective cartridge, and pivotal about a cylinder axis generally parallel to the barrel axis, the barrel axis lying between the cylinder axis and the grip, whereby in any of a plurality of positions of the cylinder one of the chambers of the cylinder lies below the cylinder axis;

a hammer pivotal on the frame about a hammer axis below the barrel axis and having an upper end engageable with the cartridge in the one chamber aligned with the barrel axis; and a firing mechanism on said frame connected between the trigger and the hammer for striking the hammer against the cartridge in the one chamber aligned with the barrel axis and thereby firing the cartridge therein, said firing mechanism being configured to substantially raise a resting point of a middle finger of the hand holding the grip.

2. The revolver according to claim 1 wherein said firing mechanism has a first pivot at the front muzzle end rotatably carrying the trigger for rotation about a front trigger axis, an anchor for locking and unlocking the cylinder, a spring biasing the anchor in a position holding the cylinder against rotation about the cylinder axis.

3. The revolver according to claim 2 wherein said firing mechanism has a second pivot at the front muzzle end and defining a distributer axis;

an inner distributor of the movement of the trigger suitable for cocking the hammer rotatable on the second pivot about the distributor axis, and a sear lockingly engageable with the hammer in a cocked position thereof.

4. The revolver according to claim 3 wherein said distributor has a first portion operatively engageable with and suitable for cocking the hammer, a second portion that can engage with and disengage from said anchor to respectively lock and unlock the cylinder, a third pivot defining a pawl axis, and a pawl engaging teeth of the cylinder for actuating same angularly of the cylinder axis.

5. The revolver according to claim 3 wherein said distributor fixedly carries a dragging member engageable with and suitable for pulling the sear into rotation at an end of a stroke of said trigger to release the hammer and cause firing.

6. The revolver according to claim 3 wherein the hammer axis is aligned substantially transversely of the barrel and cylinder axes with a point at which the hammer strikes the cartridge.

7. The revolver according to claim 6 wherein the hammer axis is between the cylinder axis and the distributor axis.

8. The revolver according to claim 3 wherein said firing mechanism has a pivot at the front muzzle end;

a cocking element of said hammer and carried on the pivot, a torsion spring bearing on the frame and operatively a bearing on the trigger, and an element operatively connected with the anchor and operable to disengage the anchor from the cylinder and release the cylinder.

9. The revolver according to claim 8 wherein said torsion spring has a first leg associated with said connecting link for pulling said distributor back into a rest position after it has carried out the cocking of said hammer.

10. The revolver according to claim 8 wherein said hammer is on an upper rear part of the grip and projects from the frame to be able to be pulled by a thumb of the hand.

11. The revolver according to claim 3, further comprising a system for locking withdrawal of the cylinder when it is removed from a respective window of said frame for loading new cartridges or for expelling fired cartridge cases, the system having engagement members between the cylinder and an extraction arm of the cylinder from the respective window.

12. The revolver according to claim 11 wherein said system comprises a nose projecting from a base of the cylinder facing the barrel, said nose being formed with a recess of circular section that rotatably couples with a matching profile of a portion of a head of a cylinder removably housed in the extraction arm of the cylinder.

13. The revolver according to claim 12, further comprising reinforcement on a side of the window of the cylinder that faces the base of the cartridge cases, said reinforcement comprising a removable plate made from material with high mechanical strength.

14. The revolver according to claim 3 wherein said distributor has a pivot which also rotatably carries a repositioning link suitable for taking the firing means back into the initial configuration taken up by it before the trigger was pulled, said link indirectly transmitting movement to said distributor acting against an arm of said rotation pawl of the cylinder so as to constantly ensure contact of said pawl against the teeth of the cylinder.

15. The revolver according to claim 14 wherein to make said hammer safe the peripheral edge of said third portion of said distributor is able to engage a pin projecting from the hammer so that when the distributor returns, before an end of travel of the trigger, said pin pulls back the hammer and consequently moves a firing pin away from a a cartridge in the cylinder.

16. The revolver according to claim 3 wherein said firing mechanism has a pivot to the front muzzle end which supports a spring that continuously acts on an abutment of said link to take said firing means back into the rest configuration.

17. The revolver according to claim 3 wherein said firing mechanism has a pivot to the front muzzle end which supports a spring acting at an application point on said hammer to make it rotate.

18. The revolver according to claim 3 wherein said firing mechanism has a pivot having a front muzzle end that defines an intercepting pin of said spring for making said hammer rotate.

19. The revolver according to claim 17 wherein said connecting link has an interference member at one end that operates, during pulling back the distributor starting from a rest position against said application point of the torsion spring on said hammer to cock said hammer.

20. The revolver according to claim 8 wherein said torsion spring has a second leg associated with a locker equipped with a cylindrical extension suitable for holding the cylinder in the closed position.

21. The revolver according to claim 20 wherein said locker holds an appendix of said disengagement element of the cylinder so that manual rotation of said disengagement element of the cylinder allows the cylinder to be freed.

22. The revolver according to claim 21 wherein a pivot to the front muzzle end carries a spring having a first leg suitable for actuating said firing mechanism through a first lever so as to take said firing means back into the rest configuration taken up before the trigger was pulled, and a second leg suitable for actuating said hammer through a second lever having a common rotation pin with said first lever, said first lever transmitting the movement to an appendix of said pawl so as to constantly ensure a contact pressure of said pawl against the toothing of the cylinder.

23. The revolver according to claim 22 wherein said control element of the disengagement of the cylinder is associated with a cylindrical pin suitable for holding the cylinder in the closed position, said cylindrical pin having a circumferential groove where a ball actuated by a spring to hold the cylinder snaps in.

24. The revolver according to claim 23 which further comprises a further sealing system that opposes the slipping out of the cylinder, consisting of a ball that, pushed by a spring, is arranged in an imprint of the cylinder extraction arm.

* * * * *